US005591066A

United States Patent [19]

Vondracek

[11] Patent Number: 5,591,066

[45] Date of Patent: Jan. 7, 1997

[54] ARRANGEMENT FOR BALL SHOT PEENING HELICAL COMPRESSION SPRINGS

[75] Inventor: Hans Vondracek, Breckerfeld, Germany

[73] Assignee: Fried. Krupp AG Hoesch-Krupp, Essen, Germany

[21] Appl. No.: 383,246

[22] Filed: Feb. 3, 1995

[30] Foreign Application Priority Data

Mar. 15, 1994 [DE] Germany ..... 44 08 645.8

[51] Int. Cl.[6] ..... B24C 3/08

[52] U.S. Cl. ..... 451/80; 451/53; 451/83; 451/146

[58] Field of Search ..... 451/80, 81, 82, 451/83, 89, 91, 96, 97, 99, 381, 385, 334, 339, 398, 49, 51

[56] References Cited

U.S. PATENT DOCUMENTS

| | | | |
|---|---|---|---|
| 2,249,677 | 7/1941 | Wallace | 451/83 |
| 2,341,674 | 2/1944 | Wallace | 451/83 |
| 3,604,158 | 9/1971 | Daffron | 451/146 |
| 4,492,102 | 1/1985 | Lienert | 72/53 |
| 4,599,879 | 7/1986 | Lienert | 72/53 |
| 4,604,881 | 8/1986 | Lienert | 451/83 |

*Primary Examiner*—Bruce M. Kisliuk
*Assistant Examiner*—George Nguyen
*Attorney, Agent, or Firm*—Max Fogiel

[57] ABSTRACT

A shotpeening machine for helical compression springs. It comprises a spring-peening chamber accommodating shot-impelling rotors, mechanisms for accommodating and tensioning the springs, and mechanisms for loading the springs into and unloading them from the accommodating and tensioning mechanisms. The accommodating and tensioning mechanisms comprise one or two spring holders (5) that travel back and forth horizontally into the peening chamber (3) and in that the loading and unloading mechanisms are prismatic belts (6) that parallel the chamber.

7 Claims, 5 Drawing Sheets

ARRANGEMENT FOR BALL SHOT PEENING HELICAL COMPRESSION SPRINGS

BACKGROUND OF THE INVENTION

The present invention concerns a machine for shotpeening helical compression springs.

The machines most commonly employed for shotpeening helical compression springs, mainly automotive suspension springs, throughout the world today use standard shot-impelling rotors.

The springs are mostly conveyed into and through the peening section by a chain that thrusts or drags them forward horizontally while they rest over two cylinders that rotate in the same direction.

The springs rotate along with the cylinders subject to friction, and the intention is uniform bombardment of the total circumference.

There is a drawback to this system, however. If the processing parameters, especially the ratios of the speeds of the chain and cylinder to the outside diameter of the springs are not absolutely precise, the springs will tend to slip back and forth more or less extensively over the cylinders.

This slippage leads in conjunction with the extreme conditions of pressure and temperature at the linear contact between the springs and the cylinders to what are called lines of friction. Lines of friction can in many cases considerably curtail the life of the component.

Further problems can occur in conveying specially shaped springs when their windings differ considerably in diameter or deviate extensively from the cylinders.

SUMMARY OF THE INVENTION

The object of the present invention is accordingly a shotpeening machine of the genus initially described herein that will lack the aforesaid drawbacks, that will be simple and economical, and that will expand the range of potential for peening tensioned helical compression springs.

The particular advantages of the shotpeening machine in accordance with the present invention is that the already stressed helical compression springs can be simply and economically subjected to peening while the detrimental friction lines on the springs are avoided. Both measures essentially prolong the life of the springs.

BRIEF DESCRIPTION OF THE DRAWINGS

Various embodiments of the present invention will now be specified with reference to the attached drawing, wherein.

DESCRIPTION OF THE PREFERRED EMBODIMENTS

Figure 1:
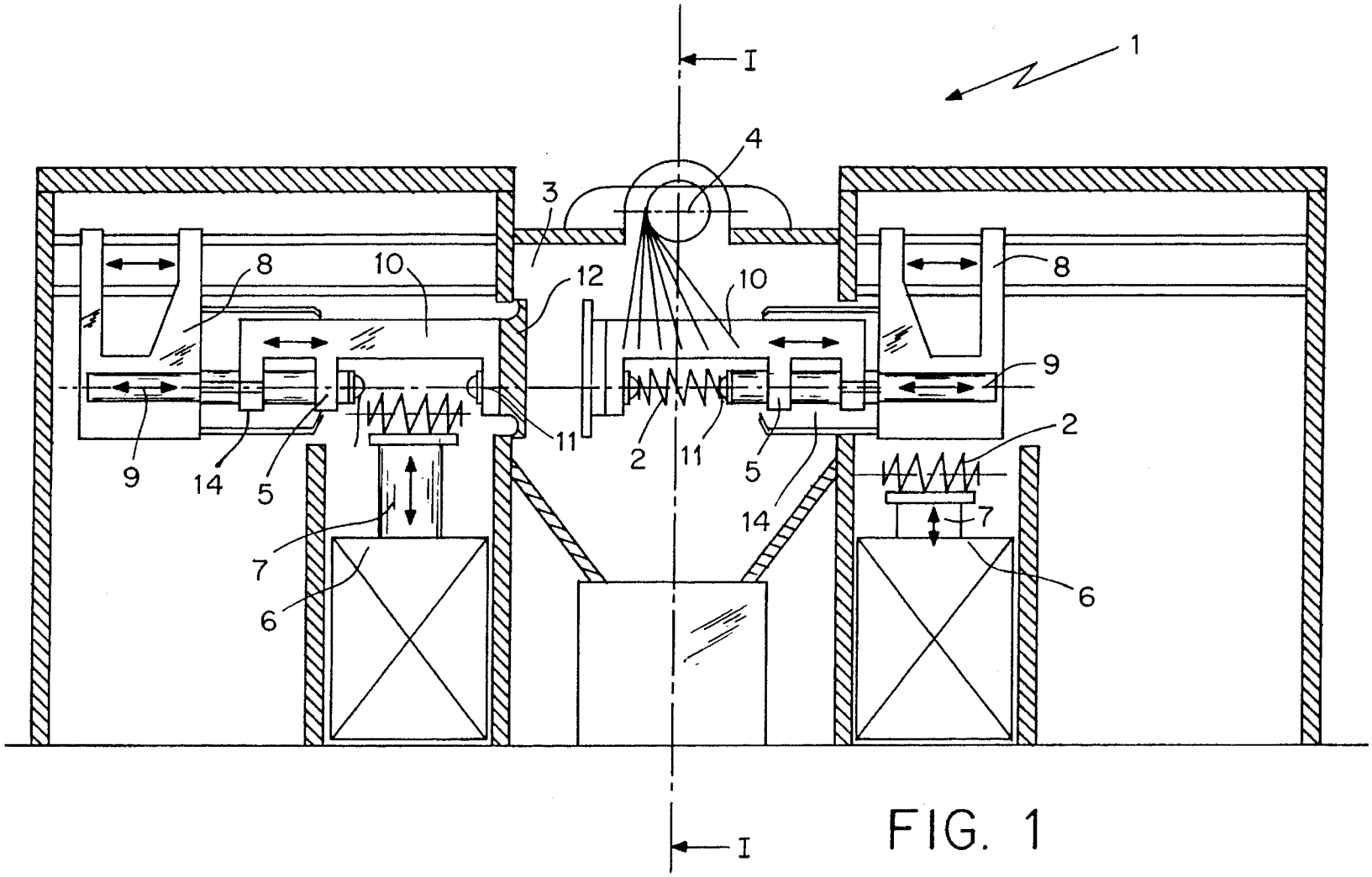
FIG. 1 is a section through an embodiment of a shotpeening machine.

As will be evident from FIGS. 1 through 5, the machine 1 in accordance with the present invention for shotpeening helical compression springs 2 essentially comprises a spring-peening chamber 3 that accommodates shot-impelling rotors 4, two spring holders 5, and two prismatic belts 6. The spring holders 5 face each other and travel horizontally back and forth in tandem. The belts 6 are perpendicular to the spring-peening chamber 3 and are provided with components 7 that lift and orient springs 2 for loading into holders 5.

Figure 2:
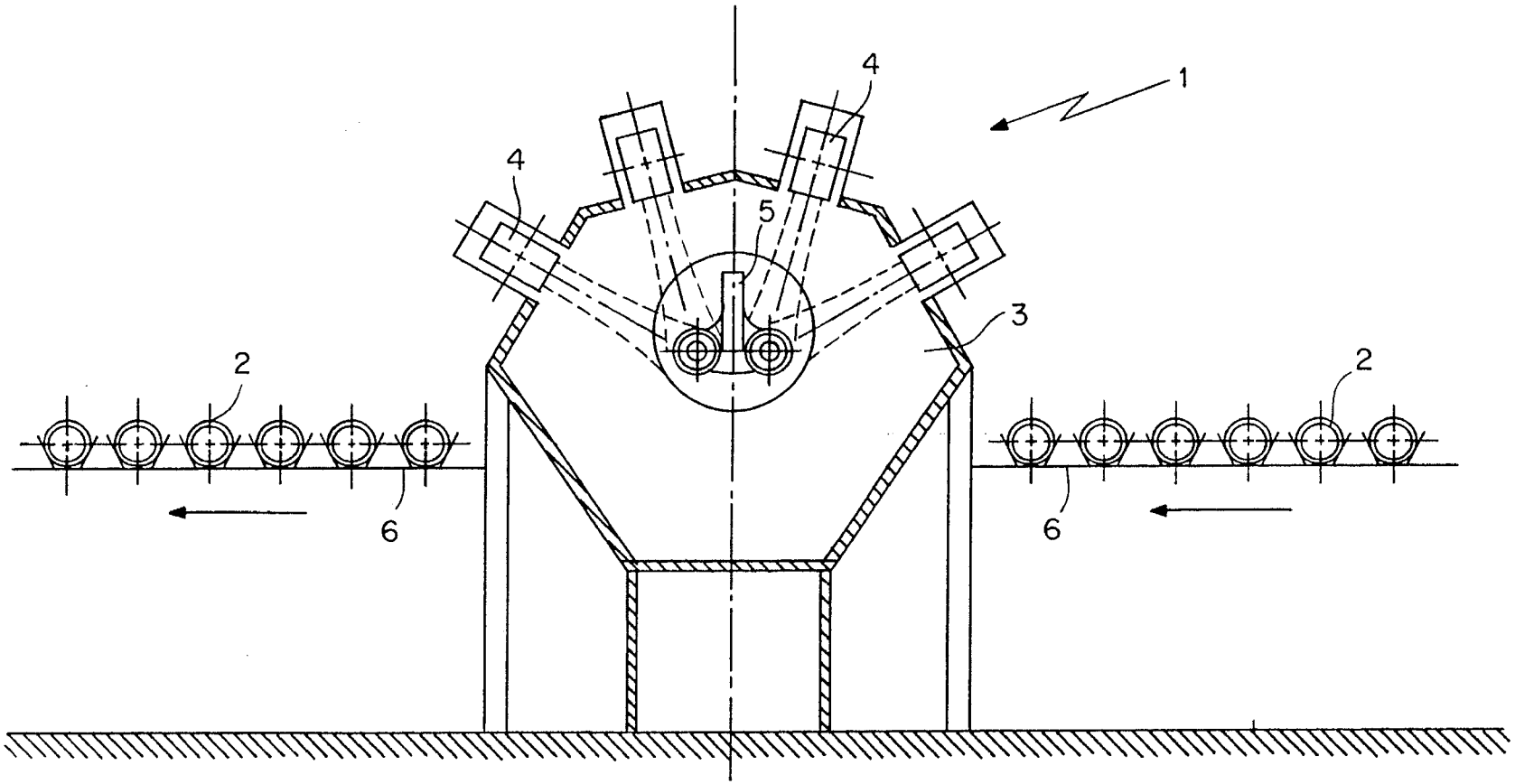
FIG. 2 is a section through the peening machine along the line I—I in FIG. 1.
Figure 3:
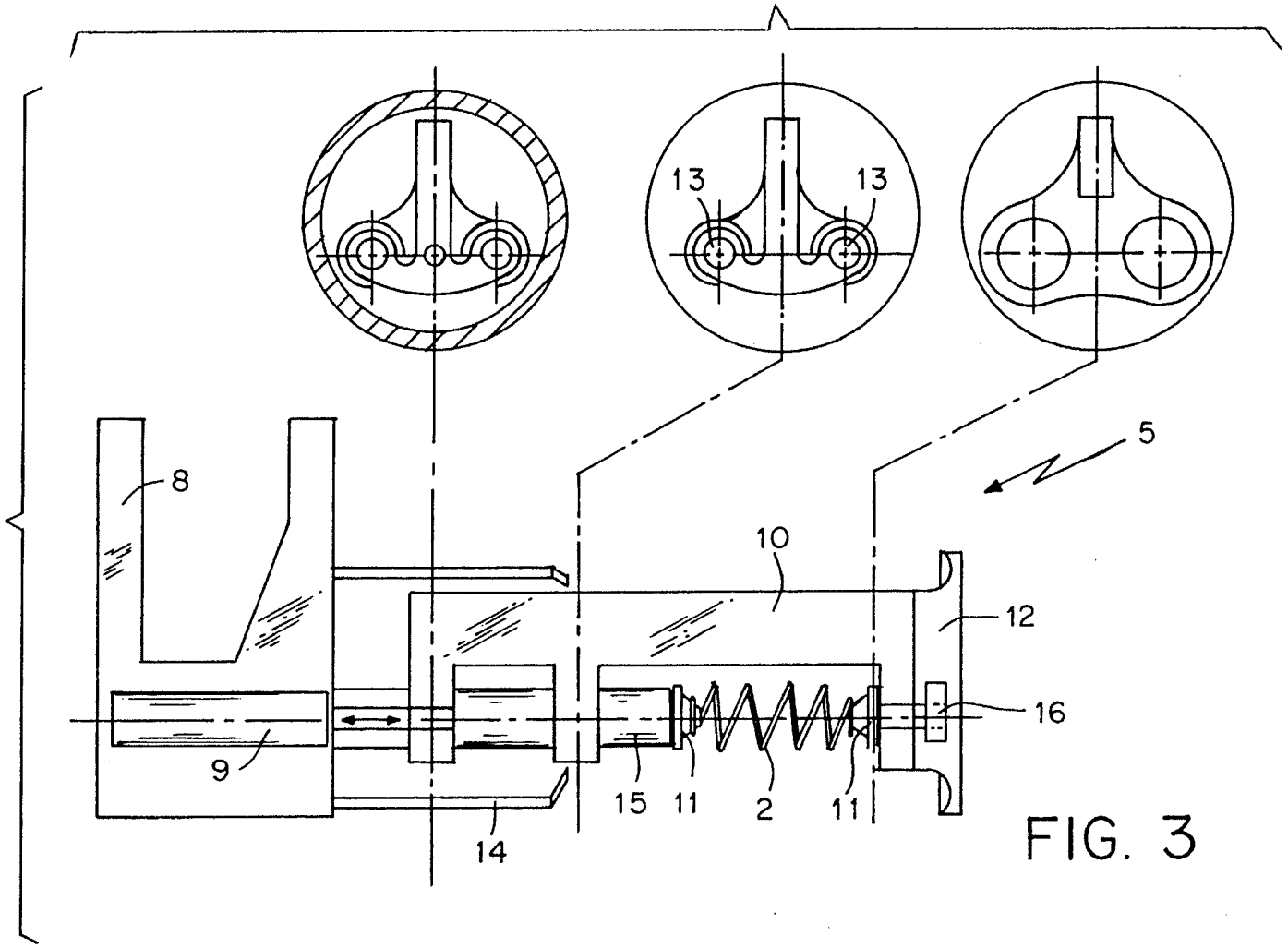
FIG. 3 illustrates the spring holder employed in the machine illustrated in FIGS. 1 and 2.

Each spring holder 5 in the shotpeening machine 1 illustrated in FIGS. 1 through 3 is provided with a carriage 8, a tensioning cylinder 9, a C-shaped bracket 10, two rotating spring accommodations 11, and a seal 12 to seal if off from spring-peening chamber 3.

C-shaped brackets 10 travel back and forth horizontally on tracks 13. The tracks are protected from the shot by sleevees 14 and 15. Sleeve 14 also acts as a seal between spring-peening chamber 3 and spring holder 5 when inside it. Each accommodation 11 is advanced and retracted by a rotating shaft 16 accommodated between the face of the accommodation and its adjacent seal 12.

The mechanisms that drive carriages 8 ensure enough force to maintain tightness during both loading and unloading.

Figure 4:
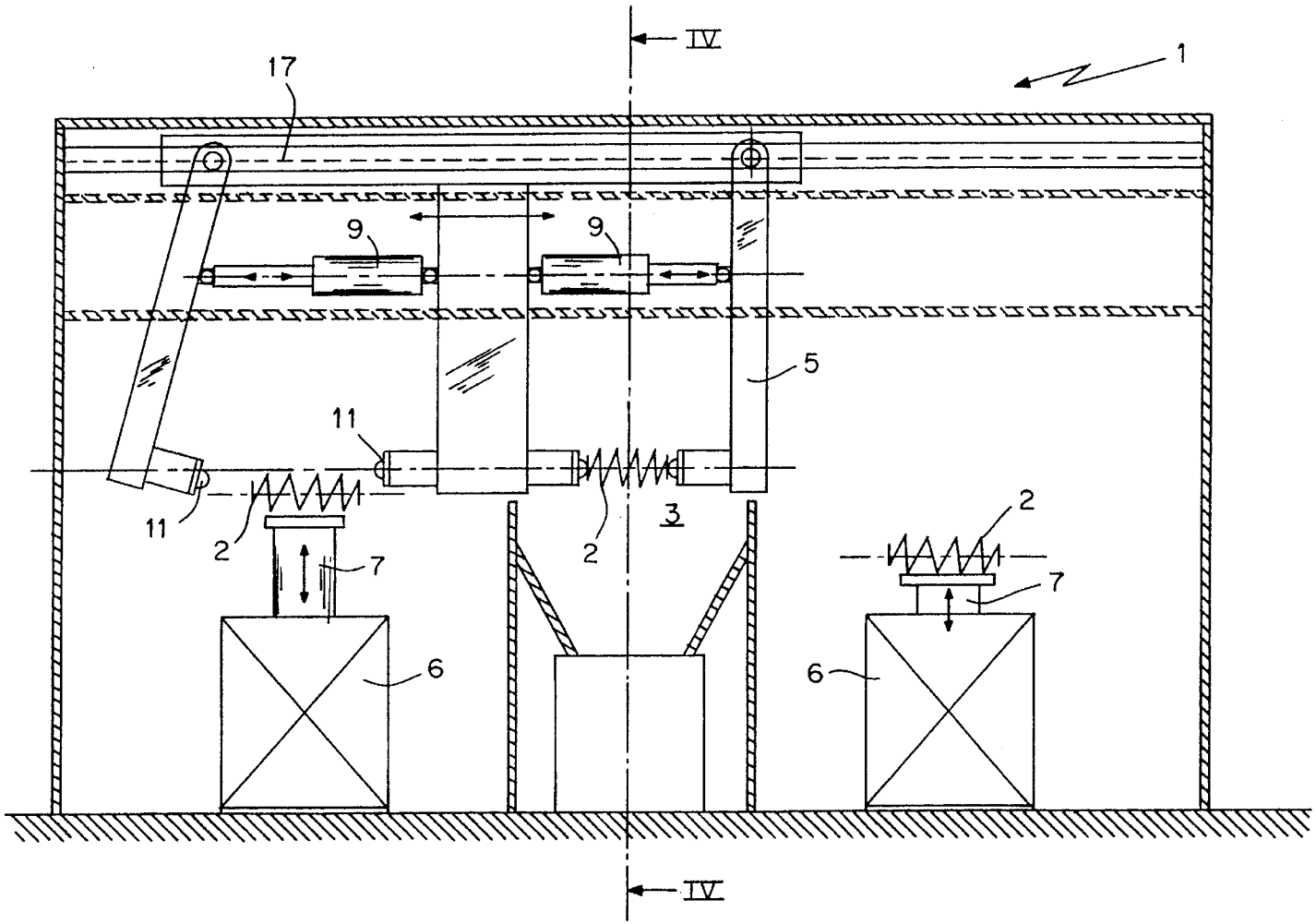
FIG. 4 is a section through another embodiment of the machine.
Figure 5:
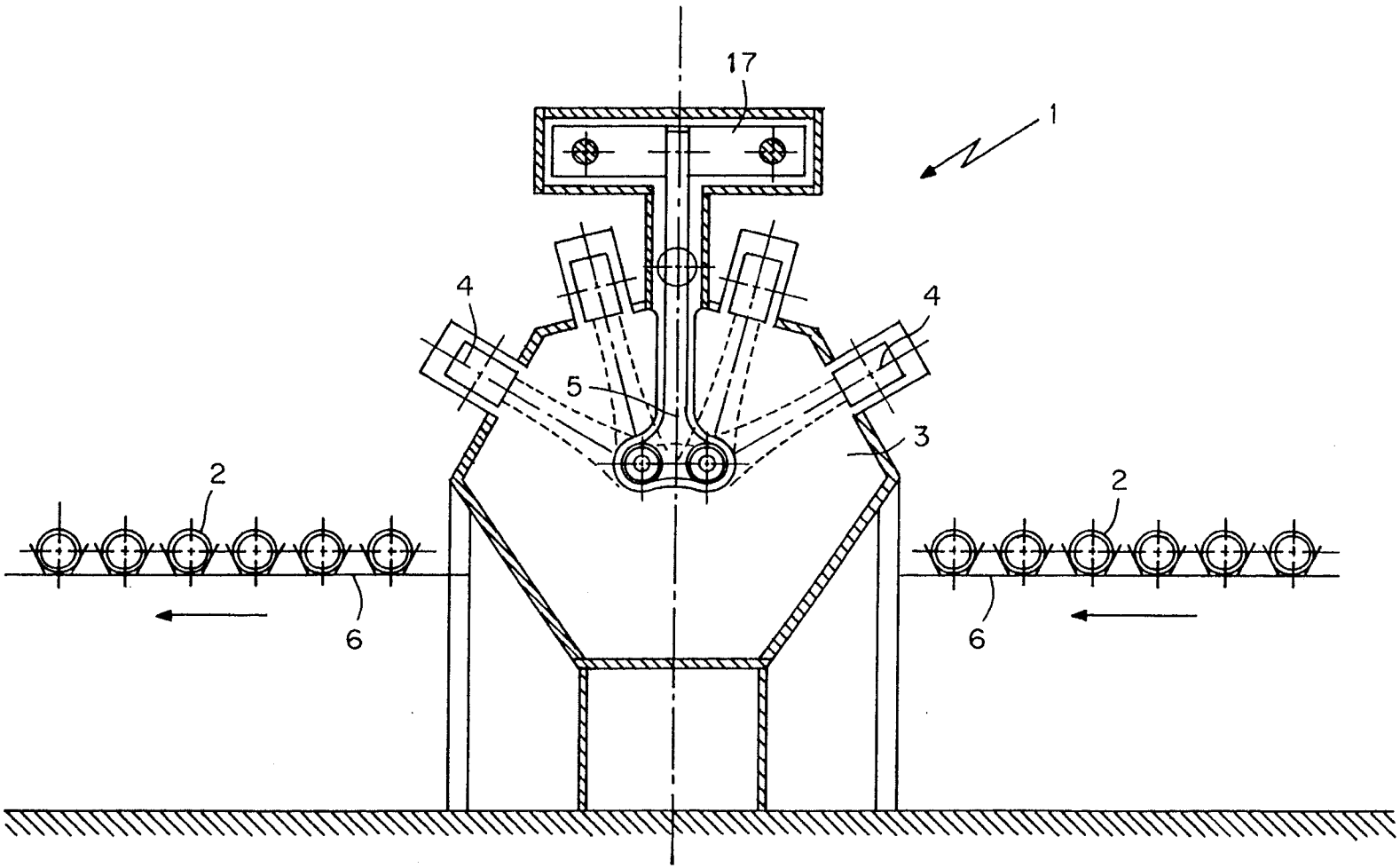
FIG. 5 is a section through the machine along the line IV—IV in FIG. 4.

The machine 1 illustrated in FIGS. 4 and 5 represents a double spring-holder system, wherein the spring holders 5 are mechanically coupled together by a common carriage 17.

I claim:

1. A shot-peening machine for helical compression springs, comprising: a spring-peening chamber having shot-impelling rotors, means for receiving and tensioning the springs, and means for loading the springs into and unloading the springs from said receiving and tensioning means; said receiving and tensioning means comprising at least one spring holder traveling back and forth horizontally into said spring-peening chamber; said loading and unloading means comprising belts directed perpendicular to said spring-peening chamber.

2. A shot-peening machine as defined in claim 1, wherein said prismatic belts are located on each side of said spring-peening chamber; and spring holders operating in tandem.

3. A shot-peening machine as defined in claim 1, wherein said belts have spring lifting-and-orienting components and said spring holders are loaded.

4. A shot-peening machine as in claim 1, wherein said spring holders move back and forth substantially parallel with axes of the springs, each spring holder having a C-shaped bracket, a spring-tensioning cylinder, and a rotating spring receiving means.

5. A shot-peening machine as defined in claim 1, wherein said spring holders are mounted each on a separate carriage traveling back and forth horizontally outside said spring-peening chamber.

6. A shot-peening machine as defined in claim 1, including a single carriage for mounting together a plurality of spring holders and traveling back and forth horizontally outside said spring-peening chamber.

7. A shot-peening machine as defined in claim 1, wherein each spring holder has a resilient seal for sealing off the spring holder in an extreme position of the spring holder from said spring-peening chamber.

* * * * *